US010478360B2

(12) United States Patent
Andersson et al.

(10) Patent No.: US 10,478,360 B2
(45) Date of Patent: Nov. 19, 2019

(54) PERSON LIFTING DEVICES WITH ACCESSORY DETECTION FEATURES AND METHODS FOR OPERATING THE SAME

(71) Applicant: Liko Research & Development AB, Luleå (SE)

(72) Inventors: Mattias Andersson, Södra Sunderbyn (SE); Andreas Bolin, Gammelstad (SE); Marica Demby, Luleå (SE); John V. Harmeyer, Cleves, OH (US); Roger Karlsson, Rosvik (SE); Douglas A. Seim, Okeana, OH (US); Varad Narayan Srivastava, Loveland, OH (US)

(73) Assignee: LIKO RESEARCH & DEVELOPMENT AB, Luleå (SE)

( * ) Notice: Subject to any disclaimer, the term of this patent is extended or adjusted under 35 U.S.C. 154(b) by 511 days.

(21) Appl. No.: 15/196,465

(22) Filed: Jun. 29, 2016

(65) Prior Publication Data

US 2017/0000672 A1 Jan. 5, 2017

Related U.S. Application Data

(60) Provisional application No. 62/187,682, filed on Jul. 1, 2015.

(51) Int. Cl.
*A61G 7/10* (2006.01)

(52) U.S. Cl.
CPC ..... *A61G 7/1065* (2013.01); *A61G 7/10* (2013.01); *A61G 7/1017* (2013.01); *A61G 7/1042* (2013.01); *A61G 7/1046* (2013.01); *A61G 7/1051* (2013.01); *A61G 2203/12* (2013.01); *A61G 2205/10* (2013.01); *A61G 2205/60* (2013.01)

(58) Field of Classification Search
CPC ..... A61G 7/10
USPC ..... 5/86.1, 81.1 R, 83.1, 89.1
See application file for complete search history.

(56) References Cited

U.S. PATENT DOCUMENTS

| | | | |
|---|---|---|---|
| 4,944,056 | A | 7/1990 | Schroeder et al. |
| 6,289,534 | B1 | 9/2001 | Hakamiun et al. |
| 6,523,195 | B1 | 2/2003 | Rodier et al. |

(Continued)

FOREIGN PATENT DOCUMENTS

| | | | |
|---|---|---|---|
| EP | 2684549 | A2 | 1/2014 |
| EP | 2727571 | A2 | 7/2014 |

(Continued)

OTHER PUBLICATIONS

UNIROPE Ltd; RFID Tags; [retrieved online on Jul. 11, 2013], http://www.unirope.com/chainmeshslings/rfid_tags.shtml. pp. 1-2.
LiftAll; RFID Tagging; [online], www.lift-all.com; (Nov. 2009). p. 1.
Extended European Search Report & Written Opinion dated Feb. 27, 2015 relating to EP Patent Application No. 13176406.0. pp. 1-12.

(Continued)

*Primary Examiner* — Fredrick C Conley
(74) *Attorney, Agent, or Firm* — Dinsmore & Shohl LLP

(57) ABSTRACT

In the embodiments described herein, the person lifting device automatically determines if an accessory, such as a sling, is properly connected to a sling bar of the person lifting device and, if the accessory is not properly connected, the person lifting device provides a user with a visual and/or audible warning and, in some embodiments, may lock-out the actuation controls of the person lifting device to prevent the person lifting device from being used.

38 Claims, 9 Drawing Sheets

(56) References Cited

U.S. PATENT DOCUMENTS

| | | | | |
|---|---|---|---|---|
| 6,637,610 | B1 * | 10/2003 | Cheeseboro | A61G 7/1015 212/324 |
| 7,240,621 | B2 | 7/2007 | Chepurny et al. | |
| 8,538,710 | B2 | 9/2013 | Todd et al. | |
| 8,910,325 | B2 | 12/2014 | Faucher et al. | |
| 2002/0138905 | A1 | 10/2002 | Bartlett et al. | |
| 2009/0049610 | A1 | 2/2009 | Heimbrock et al. | |
| 2009/0307840 | A1 | 12/2009 | Lingegard | |
| 2010/0001838 | A1 | 1/2010 | Miodownik et al. | |
| 2010/0097181 | A1 | 4/2010 | Sorensen et al. | |
| 2010/0192296 | A1 | 8/2010 | Clough | |
| 2010/0217618 | A1 | 8/2010 | Piccirillo et al. | |
| 2010/0224841 | A1 | 9/2010 | Liljedahl | |
| 2011/0035058 | A1 | 2/2011 | Clough | |
| 2011/0301440 | A1 | 12/2011 | Riley et al. | |
| 2012/0095777 | A1 | 4/2012 | Chang et al. | |
| 2013/0019401 | A1 | 1/2013 | Faucher et al. | |
| 2013/0076517 | A1 | 3/2013 | Penninger et al. | |
| 2013/0091631 | A1 | 4/2013 | Hayes et al. | |
| 2013/0205501 | A1 | 8/2013 | Robertson et al. | |
| 2013/0253291 | A1 | 9/2013 | Dixon et al. | |
| 2013/0319775 | A1 | 12/2013 | Ngoh et al. | |
| 2014/0013503 | A1 * | 1/2014 | Dixon | A61G 7/1073 5/85.1 |
| 2014/0020175 | A1 | 1/2014 | Dixon et al. | |
| 2014/0115778 | A1 | 5/2014 | Ng | |
| 2017/0027794 | A1 | 2/2017 | Andersson et al. | |
| 2017/0027797 | A1 | 2/2017 | Dolliver et al. | |

FOREIGN PATENT DOCUMENTS

| | | | |
|---|---|---|---|
| WO | 2007075701 | A2 | 7/2007 |
| WO | 2010141865 | A1 | 12/2010 |
| WO | 2015024569 | A1 | 2/2015 |

OTHER PUBLICATIONS

Non-Final Office Action dated Jun. 12, 2014 relating to U.S. Appl. No. 13/941,161, filed Jul. 12, 2013. pp. 1-10.
Non-Final Office Action dated Feb. 9, 2015 relating to U.S. Appl. No. 13/941,161, filed Jul. 12, 2013. pp. 1-11.
Non-Final Office Action dated Dec. 3, 2015 relating to U.S. Appl. No. 13/941,161, filed Jul. 12, 2013. pp. 1-13.
Non-Final Office Action dated Sep. 10, 2015 relating to U.S. Appl. No. 13/941,179, filed Jul. 12, 2013. pp. 1-9.
Non-Final Office Action dated Nov. 17, 2016 relating to U.S. Appl. No. 13/941,161, filed Jul. 12, 2013. pp. 1-16.
Final Office Action dated Sep. 19, 2016 relating to U.S. Appl. No. 13/941,161, filed Jul. 12, 2013. pp. 1-15.
Non-Final Office Action dated May 16, 2016 relating to U.S. Appl. No. 13/941,161, filed Jul. 12, 2013. pp. 1-13.
Final Office Action dated Apr. 12, 2016 relating to U.S. Appl. No. 13/941,179, filed Jul. 12, 2013. pp. 1-9.
Non-Final Office Action dated Aug. 3, 2016 relating to U.S. Appl. No. 13/941,179, filed Jul. 12, 2013. pp. 1-10.
Final Office Action dated Jan. 30, 2017 relating to U.S. Appl. No. 13/941,179, filed Jul. 12, 2013. pp. 1-11.
Letter dated Sep. 15, 2014 from Ari M. Bai with Poisinelli; One East Street, Syuite 1200; Phoenix, AZ 85004-2568 Re: U.S. Appl. No. 13/941,161 Monitoring Systems Devices and Methods for Patient Lift. Refers to U.S. Pat. No. 8,538,710 and U.S. Publication No. 2014/0013503.
Claim Chart for U.S. Patent Application Publication No. 201410013503 ('503 Application), Dixon et al. Monitoring Systems Devices and Methods for Patient Lift. Refers to U.S. Pat. No. 8,538,710 (the '710 Patent) Todd et al. Methods and Systems for Monitoring Lift Usage.
Extended European Search Report dated Nov. 14, 2016 relating to EP Patent Application No. 16176711.6. pp. 1-12.
Extended European Search Report dated Dec. 12, 2016 relating to EP Patent Application No. 16181917.2. pp. 1-7.

* cited by examiner

PERSON LIFTING DEVICES WITH ACCESSORY DETECTION FEATURES AND METHODS FOR OPERATING THE SAME

CROSS REFERENCE TO RELATED APPLICATIONS

The present specification claims priority to U.S. Provisional Patent Application Ser. No. 62/187,682 filed Jul. 1, 2015 and entitled "Person Lifting Devices With Accessory Detection Features and Methods for Operating the Same," the entirety of which is incorporated herein by reference.

BACKGROUND

Field

The present specification generally relates to person lifting devices, such as mobile lifts and/or overhead lifts and, more particularly, to person lifting devices with sling detection features and methods for operating the same.

Technical Background

Person lifting devices, such as mobile lifts and/or overhead lifts, may used in hospitals, other health care facilities, and sometimes in home care settings to move a person from one location to another or to assist the person in moving. Conventional person lifting devices utilize a sling or other attachment to secure a person to the lifting device and an actuator to lift the person to a higher elevation or lower the person to a lower elevation. In one typical example the caregiver operates the actuator to raise the patient off a bed, repositions the person by moving the lifting device to a desired location, and then operates the actuator again to lower the patient to the destination.

The various accessories for attachment to the person lifting device may be designed to be used in a specific orientation to facilitate proper lifting. A need exists for alternative methods for insuring the placement and orientation of lift accessories on person lifting devices.

SUMMARY

According to one embodiment, a method for operating a person lifting device may include detecting, with a first coupling detector, an identification of a first accessory coupling attached to a first lifting hook of a sling bar of the person lifting device; determining, automatically with an electronic control unit communicatively coupled to the first coupling detector, a type of the first accessory coupling based on the identification of the first accessory coupling; detecting, with the first coupling detector, an identification of a second accessory coupling attached to the first lifting hook of the sling bar of the person lifting device; determining, automatically with the electronic control unit communicatively coupled to the first coupling detector, a type of the second accessory coupling based on the identification of the second accessory coupling; comparing, with the electronic control unit communicatively coupled to the first coupling detector, the type of the first accessory coupling and the type of the second accessory coupling; and communicating, automatically with the electronic control unit, a warning signal when the type of the first accessory coupling and the type of the second accessory coupling are different.

According to another embodiment, a method for operating a person lifting device, may include detecting, with at least one coupling detector, an identification of an accessory coupling of an accessory attached to a lifting hook of a sling bar of the person lifting device; comparing, automatically with an electronic control unit communicatively coupled to the at least one coupling detector, the identification of the accessory coupling with an array of one or more compatible accessory couplings associated with the lifting hook of the sling bar; and communicating, automatically with the electronic control unit, a warning signal when the identification of the accessory coupling is not in the array of one or more compatible accessory couplings.

According to another embodiment, a person lifting device may include a lift actuator operatively connected to a sling bar, whereby the lift actuator raises and lowers the sling bar and at least one coupling detector. An electronic control unit may be communicatively coupled to the lift actuator and the at least one coupling detector. The electronic control unit may comprise a processor and a computer readable and executable instruction set which, when executed by the processor: detects, automatically with the at least one coupling detector, an identification of an accessory coupling of an accessory attached to a lifting hook of the sling bar of the person lifting device; compares, automatically with the electronic control unit communicatively coupled to the at least one coupling detector, the identification of the accessory coupling with an array of one or more compatible accessory couplings associated with the lifting hook of the sling bar; and communicates, automatically with the electronic control unit, a warning signal when the identification of the accessory coupling is not in the array of one or more compatible accessory couplings.

In another embodiment, a person lifting device may include a lift actuator operatively connected to a sling bar, whereby the lift actuator raises and lowers the sling bar and at least one coupling detector. An electronic control unit communicatively coupled to the lift actuator and the at least one coupling detector. The electronic control unit may include a processor and a computer readable and executable instruction set which, when executed by the processor: detects, with a first coupling detector, an identification of a first accessory coupling attached to a first lifting hook of the sling bar of the person lifting device; determines, automatically with the electronic control unit communicatively coupled to the first coupling detector, a type of the first accessory coupling based on the identification of the first accessory coupling; detects, with the first coupling detector, an identification of a second accessory coupling attached to the first lifting hook of the sling bar of the person lifting device; determines, automatically with the electronic control unit communicatively coupled to the first coupling detector, a type of the second accessory coupling based on the identification of the second accessory coupling; compares, with the electronic control unit communicatively coupled to the first coupling detector, the type of the first accessory coupling and the type of the second accessory coupling; and communicates, automatically with the electronic control unit, a warning signal when the type of the first accessory coupling and the type of the second accessory coupling are different.

According to another embodiment, a method for operating a person lifting device may include capturing, with at least one coupling detector, an image of an accessory coupling of an accessory attached to a sling bar of the person lifting device. Thereafter, the image is compared, automatically with an electronic control unit communicatively coupled to the at least one coupling detector, to an image of a properly connected accessory coupling stored in a memory of the control unit. The control unit automatically communicates a warning signal when the image of the accessory coupling is different than the image of the properly connected accessory coupling.

Additional features of the person lifting devices with sling detection features and methods for operating the same described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1A:
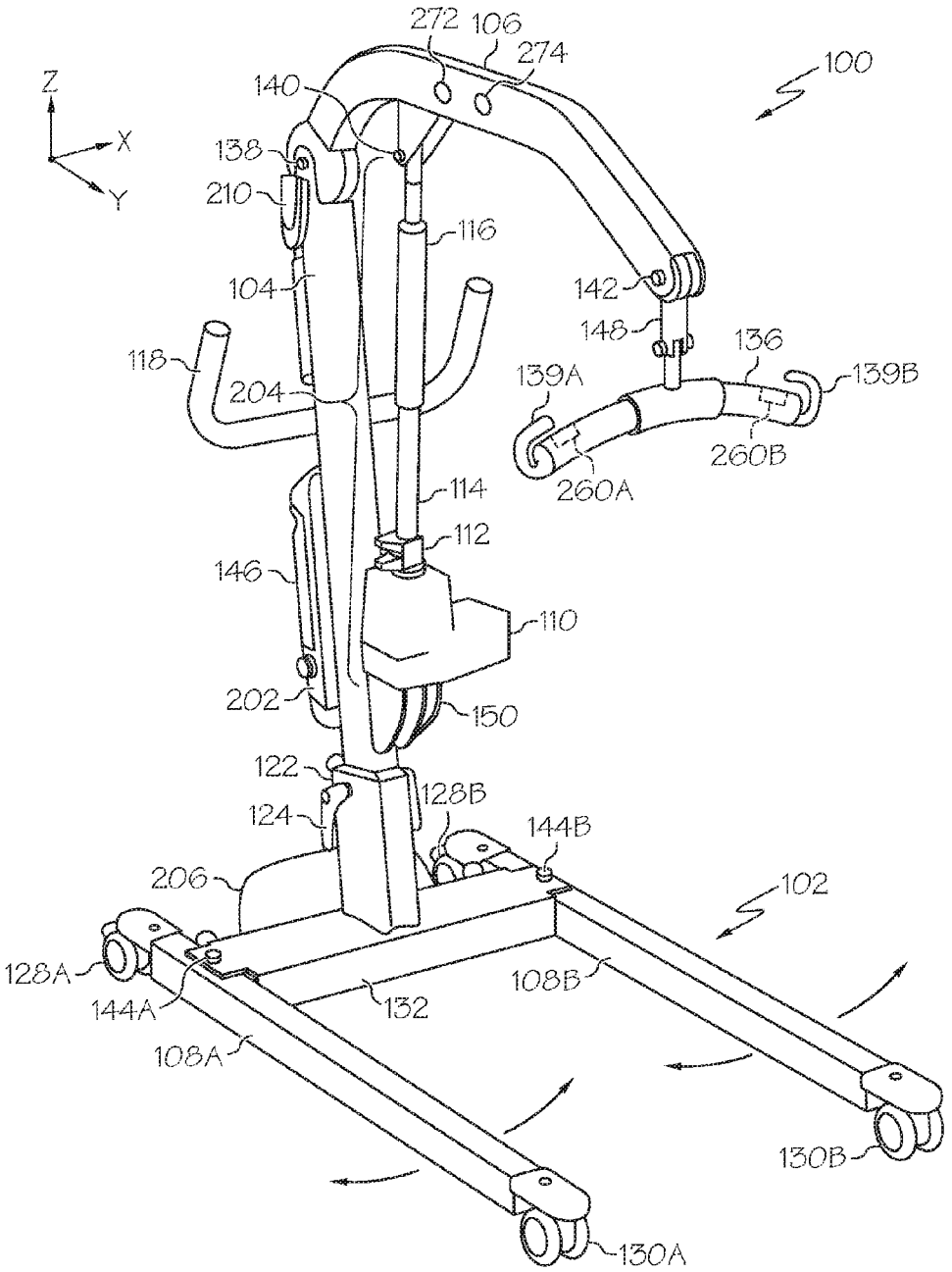
FIG. 1A schematically depicts a front perspective view of a mobile lift according to one or more embodiments shown and described herein.

Reference will now be made in detail to embodiments of person lifting devices and methods of operating the same, examples of which are illustrated in the accompanying drawings. Whenever possible, the same reference numerals will be used throughout the drawings to refer to the same or like parts. One embodiment of a person lifting device is schematically depicted in FIG. 1, and is designated by the reference numeral 100. A method for operating the person lifting device may include detecting, with at least one coupling detector, an identification of an accessory coupling of an accessory attached to a lifting hook of a sling bar of the person lifting device; comparing, automatically with an electronic control unit communicatively coupled to the at least one coupling detector, the identification of the accessory coupling with an array of one or more compatible accessory couplings associated with the lifting hook of the sling bar; and communicating, automatically with the electronic control unit, a warning signal when the identification of the accessory coupling is not in the array of one or more compatible accessory couplings. Various embodiments of person lifting devices and methods for operating the same will be described herein with specific reference to the appended drawings.

Figure 1B:
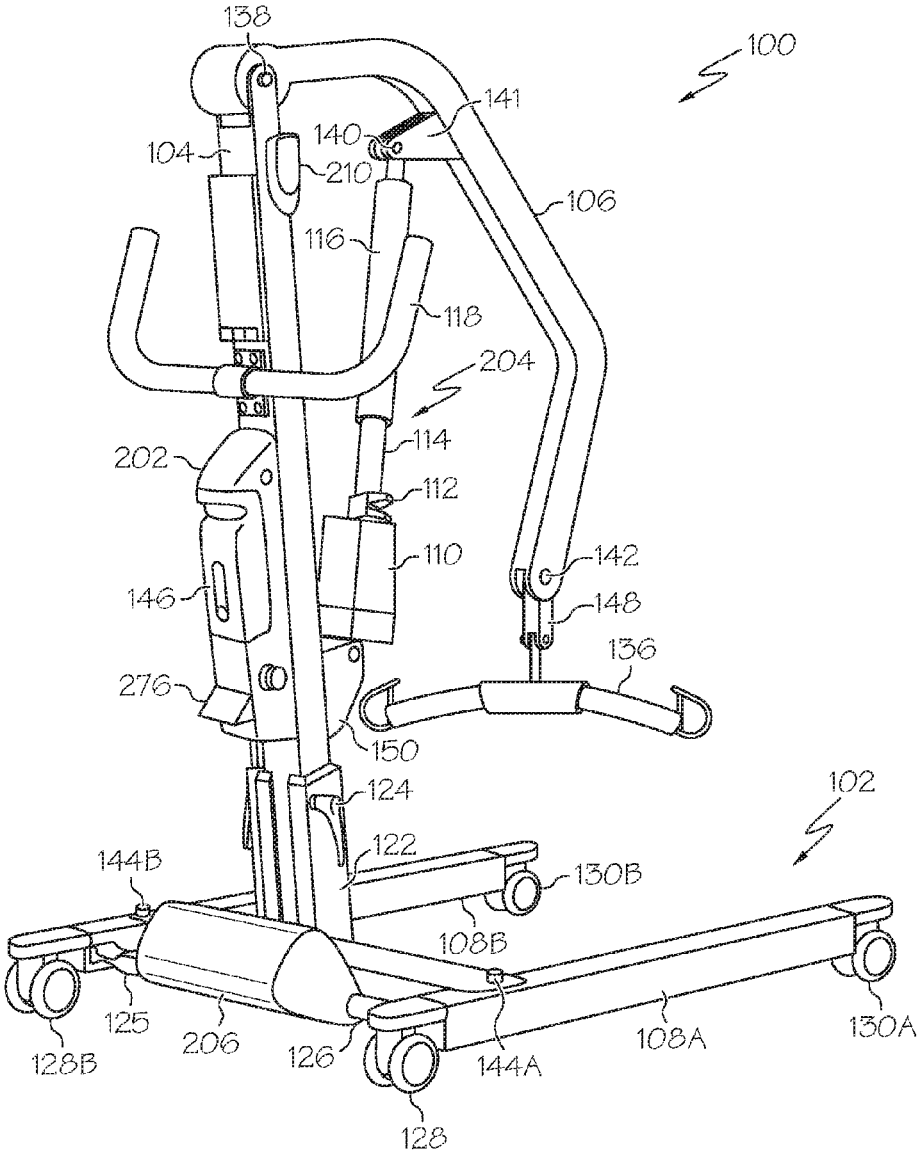
FIG. 1B schematically depicts a rear perspective view of a mobile lift according to one or more embodiments shown and described herein.

Referring now to FIGS. 1A and 1B, one embodiment of a person lifting device 100 is schematically illustrated. The person lifting device 100 may generally comprise a base 102, a lift mast 104 and a lift arm 106. The base may comprise a pair of base legs 108A, 108B which are pivotally attached to a cross support 132 at base leg pivots 144A, 144B such that the base legs 108A, 108B may be pivotally adjusted with respect to the lift mast 104 as indicated by the arrows. The base legs 108A, 108B may be pivoted with the base actuator 206 which is mechanically coupled to both base legs 108A, 108B with base motor linkages 125, 126. In one embodiment, the base actuator 206 may comprise a linear actuator such as a motor mechanically coupled to telescoping threaded rods connected to the base motor linkages 125, 126 such that, when an armature of the motor is rotated, one of the threaded rods is extended or retracted relative to the other. For example, in the configuration shown in FIGS. 1A and 1B, when the rods are extended, the base legs 108A and 108B are pivoted towards one another and, when the rods are retracted, the base legs 108A and 108B are pivoted away from one another. The base legs 108A, 108B may additionally comprise a pair of front castors 130A, 130B and a pair of rear castors 128A, 128B. The rear castors 128A, 128B may comprise castor brakes (not shown).

In one embodiment, the base 102 may further comprise a mast support 122 disposed on the cross support 132. In one embodiment, the mast support 122 may be a rectangular receptacle configured to receive the lift mast 104 of the person lifting device 100. For example, a first end of the lift mast 104 may be adjustably received in the mast support 122 and secured with a pin, threaded fastener, or a similar fastener coupled to the adjustment handle 124. The pin or threaded fastener extends through the mast support 122 and into a corresponding adjustment hole(s) (not shown) on the lift mast 104. Accordingly, it will be understood that the position of the lift mast 104 may be adjusted vertically (e.g., in the +/−Z direction on the coordinate axes shown in FIG. 1A) with respect to the base 102 by repositioning the lift mast 104 in the mast support 122. The lift mast 104 may further comprise at least one handle 118 coupled to the lift mast 104. The handle 118 may provide an operator with a grip for moving the person lifting device 100 on the casters. Accordingly, it should be understood that, in at least one embodiment, the person lifting device 100 is mobile.

The person lifting device 100 may further comprise a lift arm 106 which is pivotally coupled to the lift mast 104 at the lift arm pivot 138 at a second end of the lift mast such that the lift arm 106 may be pivoted (e.g., raised and lowered) with respect to the base 102. FIG. 1A shows the lift arm 106 in the fully raised position while FIG. 1B shows the lift arm in the fully lowered position. The lift arm 106 may comprise at least one sling bar 136 coupled to the lift arm 106 with an accessory coupling 148 such that the sling bar 136 is raised or lowered with the lift arm 106. In the embodiment shown in FIGS. 1A and 1B the accessory coupling 148 is pivotally attached to the lift arm 106 at an end of the lift arm 106 opposite the lift arm pivot 138. In one embodiment, the accessory coupling 148 is pivotally attached to the lift arm 106 at attachment pivot 142 such that the sling bar 136 may be pivoted with respect to the lift arm 106. However, it should be understood that, in other embodiments, the accessory coupling 148 may be fixedly attached to the lift arm 106 or that the sling bar 136 may be directly coupled to the lift arm 106 without the use of an accessory coupling 148.

In the embodiments described herein, the person lifting device 100 is a mechanized lifting device. Accordingly, raising and lowering the lift arm 106 with respect to the base 102 may be achieved using an actuator such as a lift actuator 204. In the embodiments shown, the lift actuator 204 is a linear actuator which comprises a motor 110 mechanically coupled to an actuator arm 114. More specifically, the motor 110 may comprise a rotating armature (not shown) and the actuator arm 114 may comprise one or more threaded rods coupled to the armature such that, when the armature is rotated, the threaded rods are extended or retracted relative to one another and the actuator arm 114 is extended or retracted. In the embodiment shown in FIG. 1, the lift actuator 204 further comprises a support tube 116 disposed over the actuator arm 114. The support tube 116 provides lateral support (e.g., support in the X and/or Y directions) to the actuator arm 114 as the actuator arm 114 is extended. The lift actuator 204 (and base actuator 206) are coupled to an electronic control unit 202 which facilitates actuation and control of both the lift actuator 204 and the base actuator 206.

In the embodiment shown in FIGS. 1A and 1B, the lift actuator 204 is fixedly mounted on the lift mast 104 and pivotally coupled to the lift arm 106. In particular, the lift mast 104 comprises a bracket 150 to which the motor 110 of the lift actuator 204 is attached while the actuator arm 114 is pivotally coupled to the lift arm 106 at the actuator pivot 140. Accordingly, it should be understood that, by actuating the lift actuator 204 with the motor 110, the actuator arm 114 is extended or retracted thereby raising or lowering the lift arm 106 relative to the base 102. In one embodiment, the lift actuator 204 may further comprise an emergency release 112. The emergency release facilitates the manual retraction of the actuator arm 114 in the event of a mechanical or electrical malfunction of the lift actuator 204.

While the embodiments described herein refer to the lift actuator 204 as comprising a motor 110 and an actuator arm 114, it will be understood that the actuator may have various other configurations and may include a hydraulic or pneumatic actuator comprising a mechanical pump or compressor, or a similar type of actuator. Further, in other embodiments, where the lifting device is a cable-based lift system, the actuator may be a motor which pays out and/or takes-up cable thereby raising and/or lowering an attached load. Accordingly, it will be understood that various other types of actuators may be used to facilitate raising and lowering the lift arm and/or an attached load with respect to the base 102.

Still referring to FIGS. 1A and 1B, the person lifting device 100 may further comprise an electronic control unit 202. The electronic control unit 202 may comprise a battery 146 and may be electrically coupled to the lift actuator 204 and the base actuator 206. The electronic control unit 202 may be operable to receive an input from an operator via a control device coupled to the electronic control unit 202. The control device may comprise a wired controller and/or one or more wireless controllers. For example, in one embodiment, the control device may be a wired controller (such as a pendant or the like) or, alternatively, a controller integrated into the electronic control unit 202. In another embodiment, the controller may be a wireless controller such as a wireless hand control and/or a wireless diagnostic monitor/control. Based on the input received from the control device, the control unit is programmed to adjust the position of the lift arm 106 and/or the position of the base legs 108A, 108B by sending electric control signals to the lift actuator 204 and/or the base actuator 206.

In the embodiments described herein, the person lifting device 100 may further comprise an accessory detector 276, such as a bar code scanner, QR code reader, RFID tag reader, machine vision system, camera, or the like, communicatively coupled to the electronic control unit 202. The accessory detector 276 may be used to detect the identity of accessories coupled to the person lifting device 100 and, in conjunction with the electronic control unit 202, determine the compatibility of the accessories, as will be described in further detail herein. For example, in the embodiment of the person lifting device 100 depicted in FIGS. 1A and 1B, the accessory detector 276 is a bar code scanner communicatively coupled to the electronic control unit 202. In this embodiment, the bar code scanner may be utilized by a caregiver to scan accessories and sling bars attached to the person lifting device 100 and store the identification of these accessories and sling bars in memory. In alternative embodiments, the accessory detector 276 may be an RFID tag reader positioned atop the person lifting device 100 with an active region that envelopes the person lifting device. However, the active region may be shaped through the use of appropriate antennas and readers such that only RFID tagged components attached to the person lifting device 100 are identified by the accessory detector 276. The accessory detector 276 may include, for example, CS468 RFID reader and a CS790 antenna available from Convergence Systems Ltd. of Hong Kong which may be used in conjunction with one another to shape the active area of the accessory detector 276. However, it should be understood that other RFID readers and antennas suitable for shaping the active area of the accessory detector 276 may be used.

While FIGS. 1A and 1B depict the person lifting device 100 as a mobile patient lift, it should be understood that the lift control systems and methods for operating a person lifting device described herein may be used in conjunction with other person lifting devices having various other configurations including, without limitation, stationary lifting devices and overhead lifting devices. Further, it should also be understood that, while specific embodiments of the person lifting device described herein relate to person lifting devices used for raising and/or lowering patients, the lift control systems described herein may be used with any lifting device which is operable to raise and lower a load.

Figure 2:
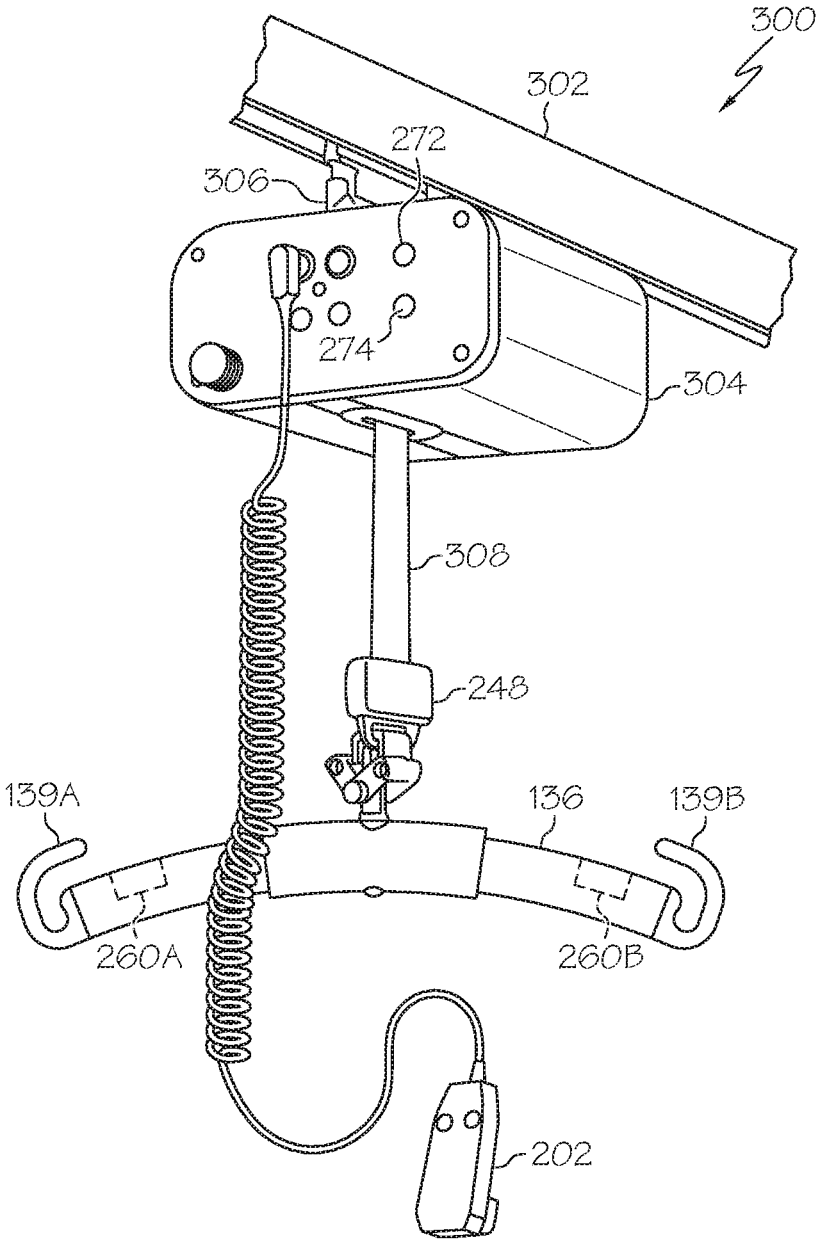
FIG. 2 schematically depicts a perspective view of an overhead lift according to one or more embodiments shown and described herein.
Figure 3:
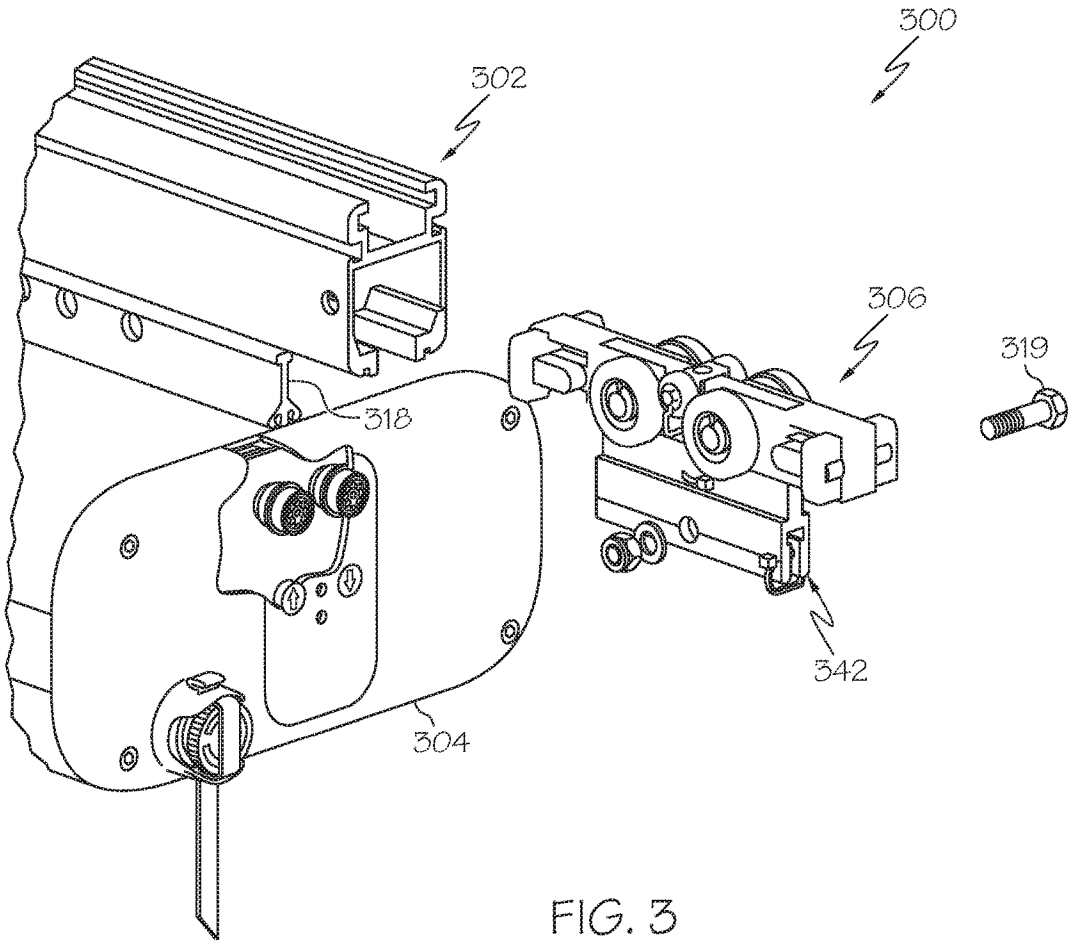
FIG. 3 schematically depicts an exploded view of the overhead lift of FIG. 2.

For example, FIGS. 2 and 3 depict another embodiment in which the person lifting device 300 is a rail-mounted lift system. In this embodiment, the person lifting device 300 generally comprises a lift unit 304 which is slidably coupled to a rail 302 with a carriage 306. The lift unit 304 may be used to support and/or lift a patient with a lifting strap 308 which is coupled to a lift actuator, in this case a motor, contained within the lift unit 304. The lift actuator facilitates paying-out or taking-up the lifting strap 308 from the lift unit 304 thereby raising and lowering a patient attached to the lifting strap 308. For example, an end of the lifting strap 308 may include an accessory coupling 248 to which a sling bar 136 may be attached. In the embodiments described herein, the lift unit 304 further includes a battery which is housed in the lift unit 304 and electrically coupled to the lift actuator thereby providing power to the lift actuator 333. However, it should be understood that, in other embodiments, the lift unit 304 may be constructed without the battery, such as when the lift actuator is directly wired to a power source. The person lifting device 300 may further include an electronic control unit 202 which is communicatively coupled to the lift actuator and facilitates actuation and control of the lift actuator, specifically paying out and taking up the lifting strap 308.

In the embodiment of the person lifting device shown in FIGS. 2 and 3, a person may be attached to the lifting strap 308 with a sling bar 136 attached to the lifting strap 308. For example, the sling bar may be attached to a harness or sling in which the person is positioned to facilitate the lifting operation. The lift unit 304 may be actuated with the electronic control unit 202 to pay out or take up the lifting strap 308 from the lift unit 304. In the embodiment shown in FIG. 2, the electronic control unit 202 is directly wired to the lift unit 304. However, it should be understood that, in other embodiments, the electronic control unit 202 may be wirelessly coupled to the lift unit 304 to facilitate remote actuation of the lift unit 304.

Referring now to the exploded view of the person lifting device 300 schematically depicted in FIG. 3, the lift unit 304 is mechanically coupled to a carriage 306 which facilitates slidably positioning the lift unit 304 along rail 302. In the embodiments of the lift unit 304 described herein, the lift unit 304 includes a connection rail 318 which is mounted to the top surface of the lift unit 304. The connection rail 318 facilitates connecting and securing the lift unit 304 to the carriage 306. In the embodiment of the lift unit 304 shown in FIG. 3, the connection rail 318 has a T-shaped configuration and the carriage 306 has a receiving slot 342 with a complimentary configuration for receiving the connection rail 318. The carriage 306 may be secured to the connection rail 318 with a fastener 319, such as a bolt and nut as depicted in FIG. 3, which extends transversely through openings in the carriage 306 and a corresponding opening in the connection rail 318.

Figure 4:
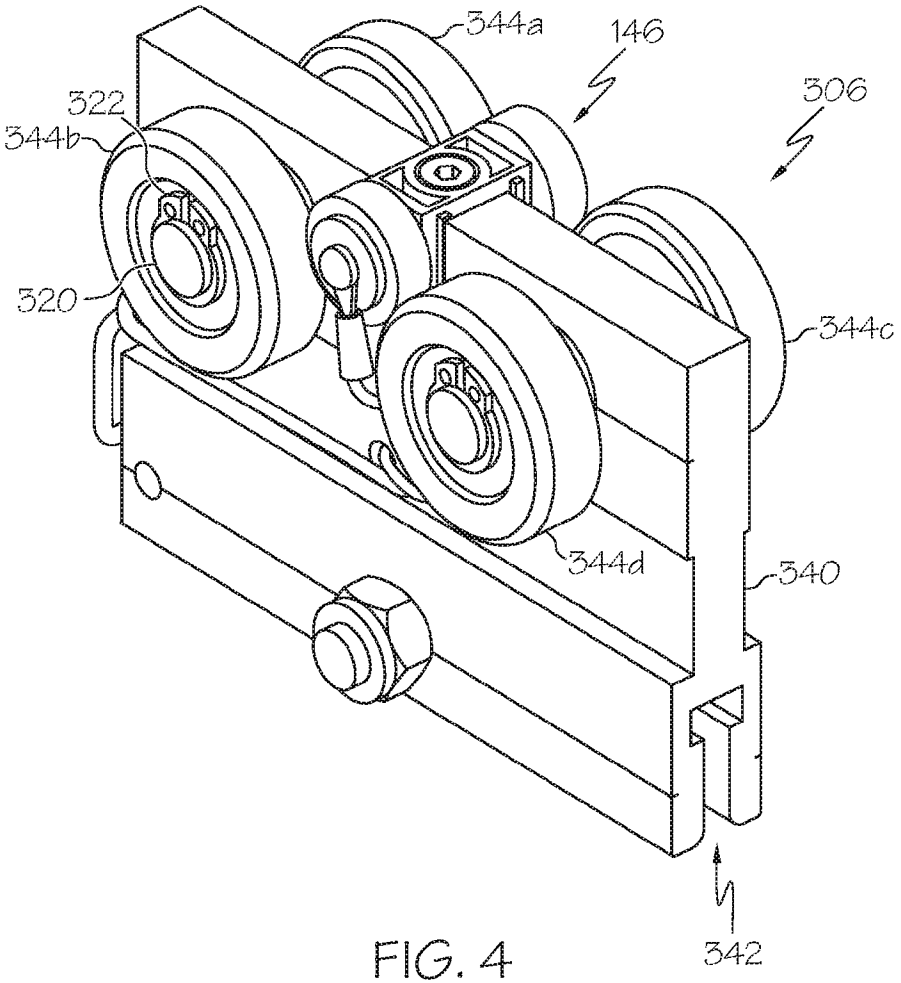
FIG. 4 schematically depicts a carriage of the overhead lift of FIGS. 2 and 3.

Referring now to FIG. 4, the carriage 306 generally comprises a carriage body 340 to which a plurality of support wheels 344*a*, 344*b*, 344*c*, and 344*d* are rotatably attached for supporting the carriage 306 in the rail. The support wheels 344*a*, 344*b*, 344*c*, and 344*d* facilitate positioning the carriage 306 and lift unit along the length of the rail. In the embodiments described herein, the carriage 306 is depicted with four support wheels. However, it is contemplated that the carriage 306 may be constructed with fewer than 4 support wheels. For example, in some embodiments, the carriage may be constructed with one or two support wheels (i.e., a pair of support wheels). Accordingly, it should be understood that the carriage 306 includes at least one support wheel. The support wheels 344*a-d* are positioned on axles 320 which extend transversely through the carriage body 340. Each support wheel is secured to the axle 320 with a fastener, such as retaining clips 322, such that the support wheels are rotatable on the axle 320.

In the embodiment of the carriage 306 depicted in FIG. 4, the support wheels 344*a*, 344*b*, 344*c*, and 344*d* are passive (i.e., the support wheels are not actively driven with a motor or a similar drive mechanism) and the lift unit is manually traversed along the rail. However, in alternative embodiments (not shown), the support wheels may be actively driven such as when the support wheels are coupled to a motor or a similar mechanism. In such embodiments, the drive mechanism may be communicatively coupled to an electronic control unit (such as electronic control unit 202 shown in FIG. 2) which actuates the drive mechanism and facilitates traversing the lift unit along the rail with the drive mechanism.

The person lifting device 300 may further comprise an accessory detector (not shown), such as a bar code scanner, QR code reader, RFID tag reader or the like, communicatively coupled to the electronic control unit 202. The accessory detector may be used to detect the identity of accessories coupled to the person lifting device 300, as described above, and, in conjunction with the electronic control unit 202, determine the compatibility of the accessories, as will be described in further detail herein.

Referring now to FIGS. 1A and 2, in the embodiments described herein the person lifting device further includes at least one coupling detector, such as coupling detectors 260A, 260B, communicatively coupled to the electronic control unit 202, either by wire or wirelessly. In embodiments, the coupling detectors may be used to determine a proper connection between an accessory (such as a sling) attached to the lifting hooks of, for example, a sling bar. For example, in embodiments, the coupling detectors 260A, 260B are utilized to detect the identification of accessory couplings (not shown) attached to the lifting hooks 139A, 139B to determine proper connection of an accessory (not shown), such as a lifting sling, lifting vest, lifting strap, lifting sheet or the like, to the sling bar 136. In an alternative embodiment, the coupling detector may be utilized to capture an image of the accessory attached to a sling bar and, based on that image, determine if the accessory is compatible with the sling bar and/or determine if there is a proper connection between the accessory and the lifting hooks of the sling bar. In the embodiments of the person lifting devices depicted in FIGS. 1A and 2, the coupling detectors 260A, 260B are radio frequency identification (RFID) readers operatively coupled to the sling bar 136. The RFID readers interrogate RFID tags operatively coupled to an accessory coupling attached to the corresponding lifting hooks 139A, 139B to determine a unique identity of the accessory coupling and, in conjunction with the electronic control unit 202, determine if the accessory is properly connected to the person lifting device. While the coupling detectors 260A, 260B have been described herein as comprising RFID readers, it should be understood that, in other embodiments, the coupling detectors 260A, 260B may be, for example, bar code readers, machine vision systems, cameras, or other, similar detectors, suitable for detecting an accessory, a sling bar, an accessory coupling of an accessory and/or reading unique identifying indicia of an accessory coupling of an accessory.

Figure 5:
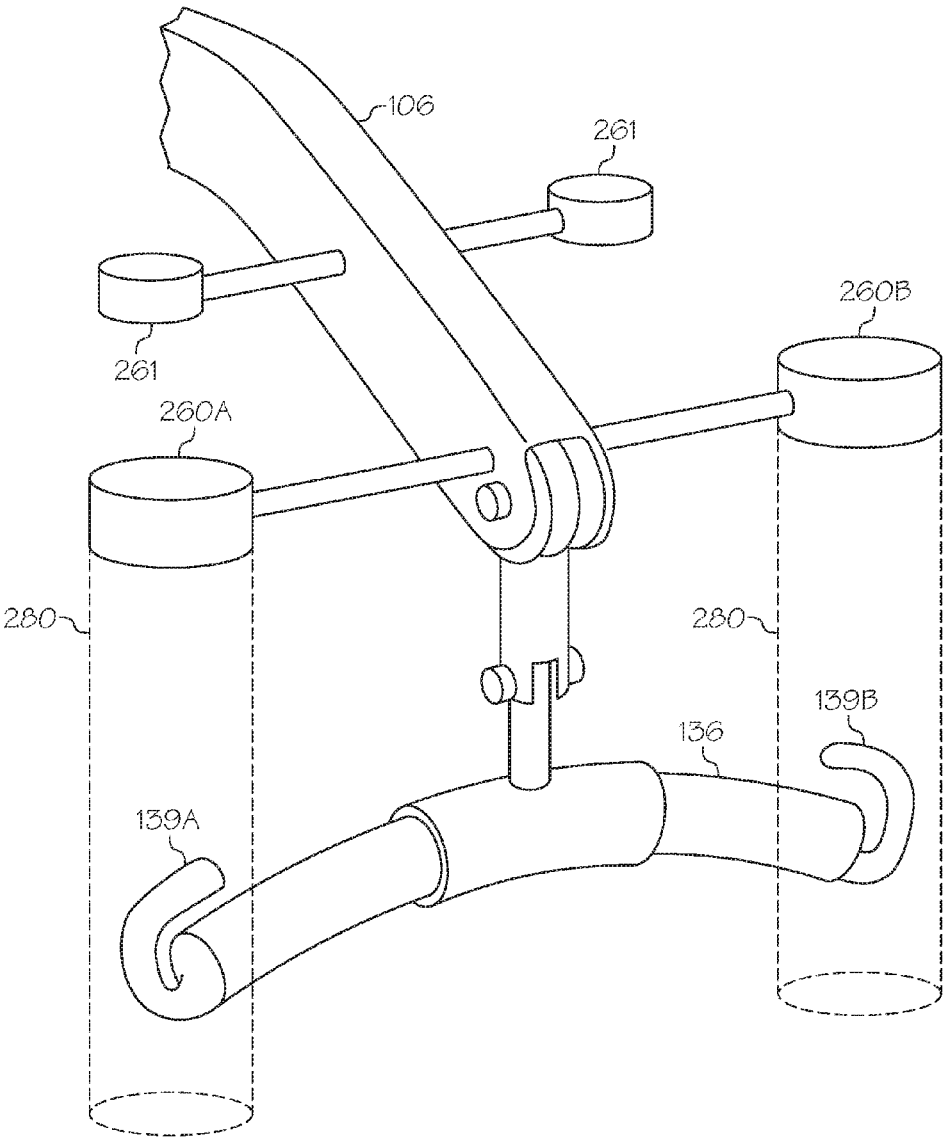
FIG. 5 schematically depicts coupling detectors attached to a person lifting device according to one or more embodiments shown and described herein.

Referring now to FIG. 5, in alternative embodiments, the coupling detectors 260A, 260B may be operatively coupled to a structural component of the person lifting device, such as the lift arm 106 of the person lifting device as shown in FIG. 5, or even the lift unit 304 of the person lifting device 300 depicted in FIG. 2. As noted above, the coupling detectors 260A, 260B are communicatively coupled to the electronic control unit 202, either by wire or wirelessly. In these embodiments, the coupling detectors 260A, 260B may be cameras or, for example, RFID readers. In embodiments where the coupling detectors are RFID readers, the RFID readers may utilize evanescent wave technology to produce a shaped and constrained active area 280 within which an RFID tag can be interrogated by the RFID reader. In these embodiments, the coupling detectors 260A, 260B may include a CS468 RFID reader and a CS790 antenna available from Convergence Systems Ltd. of Hong Kong which may be used in conjunction with one another to shape the active areas of the coupling detectors. However, it should be understood that other RFID readers and antennas suitable for shaping the active area of the reader may be used. In these embodiments, the active areas 280 of the coupling detectors 260A, 260B extend from the coupling detectors a distance to sufficient to envelope the end portions of the sling bar 136, including the lifting hooks 139A, 139B, so that the coupling detectors 260A, 260B are able to interrogate an RFID tag attached to an accessory coupling engaged with the corresponding lifting hooks 139A, 139B. However, due to the shape and constraint of the active areas 280, the coupling detectors 260A, 260B do not detect or interrogate RFID tags located outside the active areas 280, thereby avoiding misdetection and mis-interrogation of RFID tags which are not associated with accessories attached to the sling bar 136 of the person lifting device. As shown in FIG. 5, the person lifting device may include multiple pairs of coupling detectors (such as coupling detectors 260A, 260B and 261A, 261B) with each pair generally corresponding to a pair of lifting hooks on a sling bar, and each individual coupling detector operatively associated with a specific lifting hook via the electronic control unit. For example, the person lifting device may contain one, two or even more pairs of coupling detectors to accommodate sling bars of various designs and numbers of lifting hooks.

Figure 6:
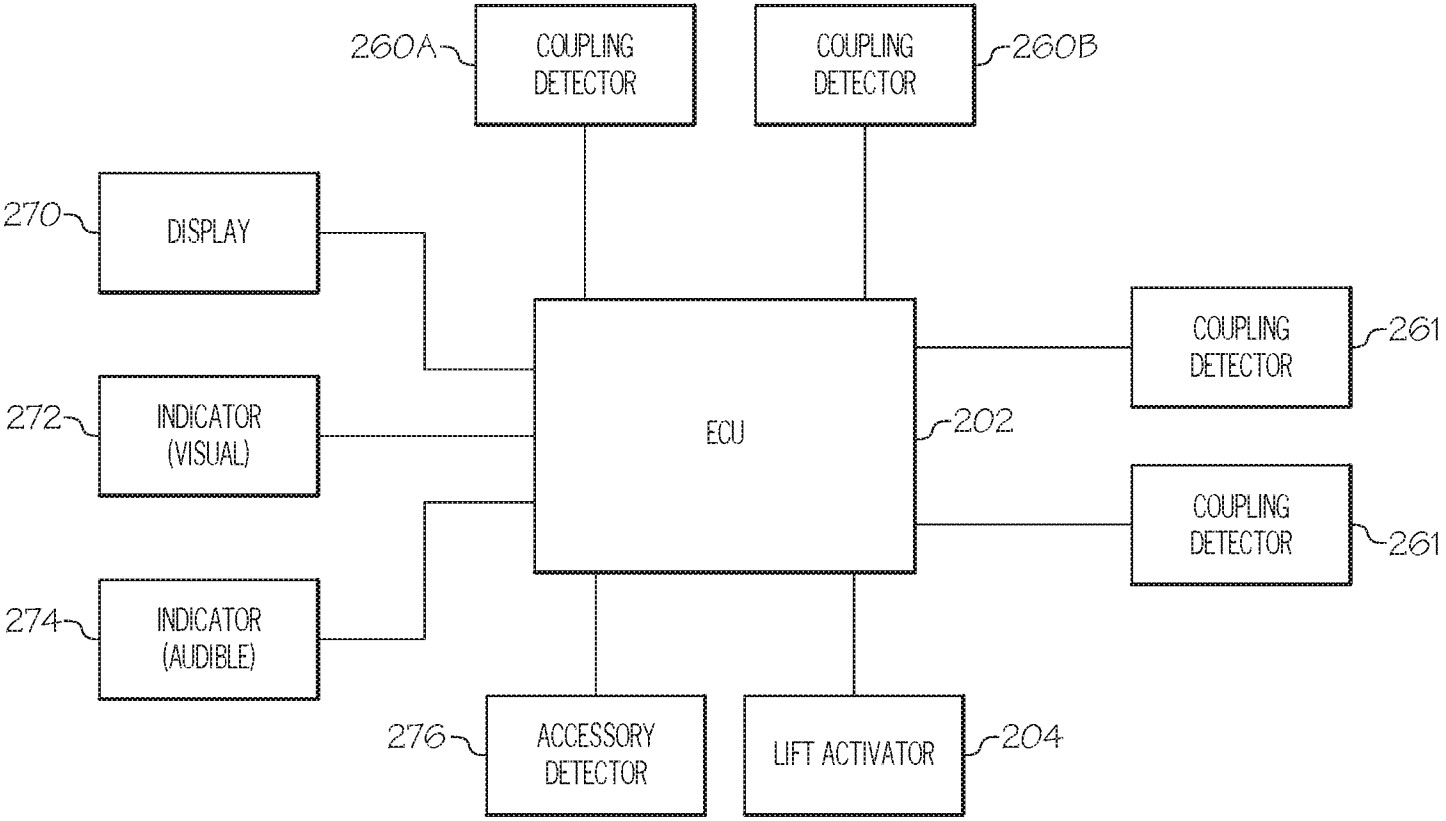
FIG. 6 schematically depicts the interconnectivity of various electrical components of a person lifting device according to one or more embodiments shown and described herein.

Referring now to FIG. 6, one embodiment of an electronic control unit 202 for use with the person lifting device 100 of FIGS. 1A and 1B, or the person lifting device 300 of FIG. 2, is schematically depicted. The electronic control unit 202 includes a processor (not shown) and a non-transient memory (not shown) which stores computer readable and executable instructions which, when executed by the processor, facilitate the operation of the person lifting device. In the embodiments described herein, the electronic control unit 202 is communicatively coupled (either wired or wirelessly) to the coupling detectors 260A, 260B and, optionally the coupling detectors 261A, 261B of the person lifting device, facilitating the receipt of data (e.g., the identification of accessory couplings connected with the sling bar) from the coupling detectors for storage and further processing by the electronic control unit 202. In addition, the electronic control unit 202 is communicatively coupled to the lift actuator 204, facilitating control of the lift actuator 204 by and through the electronic control unit 202 and enabling a person attached to the person lifting device to be raised and/or lowered. In addition, the electronic control unit 202 may be communicatively coupled to a display 270, such as an LCD or LED display, facilitating the display of lift data from the electronic control unit 202. For example, the electronic control unit 202 may display information on the display 270 relating to the type of lift accessories attached to the person lifting device, operating constraints of the person lifting device such as weight limit, lift height, etc., number of lifts performed, service required, and the like. In addition, a visual indicator 272 and/or an audible indicator 274 may be communicatively coupled to the electronic control unit 202 and may be used to provide feedback to an operator of the lift. Such feedback may include, for example, visual and/or audible indications of whether the correct sling bar and accessories are attached to the person lifting device, whether a battery of the lifting device is fully charged, whether the accessories are properly connected to the sling bar of the person lifting device, and the like. In embodiments, the visual indicator 272 and/or audible indicator may be, for example, attached to the lift arm 106 of the person lifting device 100 depicted in FIGS. 1A and 1B, or may be attached to the lift unit 304 of the person lifting device 300 depicted in FIG. 2. The electronic control unit 202 may also be communicatively coupled to the accessory detector 276 facilitating the receipt of data related to the identity of accessories attached to the person lifting apparatus.

Figure 7:
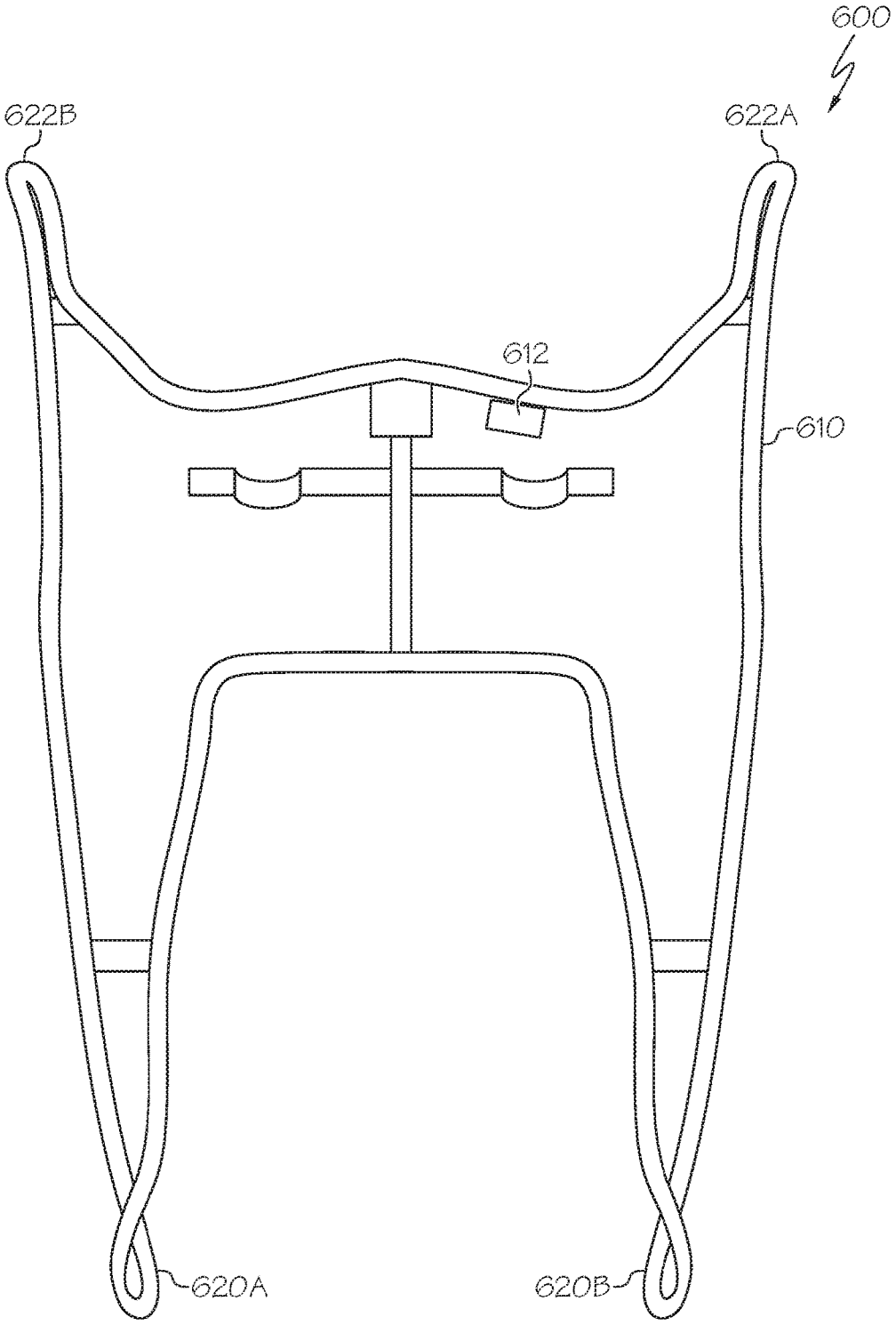
FIG. 7 schematically depicts an accessory, specifically a lift sling, for attachment to a person lifting device according to one or more embodiments shown and described herein.

Referring now to FIG. 7, one embodiment of an accessory 600 for attachment to the sling bar 136 of the person lifting devices described herein is schematically depicted. In the embodiment depicted in FIG. 7, the accessory 600 is a lifting sling. However, it should be understood that other types of accessories are contemplated and possible. The accessory 600 includes a body 610 and a plurality of accessory couplings 620A, 620B, 622A, 622B for attaching the accessory to the lifting hooks of a sling bar. In embodiments, the accessory 600 may have identifying indicia 612 affixed to the accessory 600, such as, for example, to the body 610 of the accessory 600. The identifying indicia 612 may be, for example, a bar code, a QR code, an RFID tag, or the like and may have encoded thereon an identification of the accessory 600 such as a model number and/or serial number. In embodiments, the accessory couplings 620A, 620B, 622A, 622B of the accessory 600 may be attached to a sling bar in a certain, predetermined configuration to facilitate proper lifting. For example, and without limitation, in the embodiment of the accessory 600 depicted in FIG. 7, the accessory 600 is intended for attachment to a two point sling bar, such as sling bar 136 depicted in FIG. 1A, with accessory couplings 620A and 622A coupled to one lifting hook and accessory couplings 620B, 622B attached to the other lifting hook. In order to insure proper attachment, each of the accessory couplings 620A, 620B, 622A, 622B may have unique identifying indicia (not shown) affixed thereto which allows for the identity of the accessory coupling to be automatically determined upon connection to a lifting hook of a sling bar and the identity to be checked against an array of compatible accessory couplings for the attachment location. Suitable identifying indicia may be, for example, a bar code, a QR code, an RFID tag, or the like and may have encoded thereon a unique identifier for the corresponding accessory coupling.

Methods of operating the person lifting devices of FIGS. 1A-1B and 2 will now be described in further detail with reference to FIGS. 1A-7.

In the embodiments described herein, the memory of the electronic control unit 202 contains a computer readable and executable instruction set which, when executed by the processor, automatically determines if an accessory 600 is properly connected to the sling bar 136 of the person lifting device and, if the accessory 600 is not properly connected, the electronic control unit 202 provides a user with a visual and/or audible warning and, in some embodiments, may lock-out the actuation controls of the person lifting device to prevent the person lifting device from being used until the controls are unlocked or an appropriate override code is entered.

In some embodiments, the method of operating the person lifting device, such as the person lifting devices 100, 300 depicted in FIGS. 1A and 2, may optionally include the preliminary step of determining if compatible accessories are attached to the person lifting device. For example, the electronic control unit 202 may prompt a user, such as with the display 270, to scan an identification tag associated with the sling bar, such as a bar code, QR code, or the like, encoded with a model number and/or serial number of the sling bar, with the accessory detector 276. Alternatively, the electronic control unit 202 may automatically detect an RFID tag associated with the sling bar attached to the person lifting device, such as when the accessory detector 276 is an RFID tag reader. Thereafter, the electronic control unit stores this identification in memory as the attached sling bar. The electronic control unit 202 then prompts the user, such as with the display 270, to scan the identifying indicia 612 on the accessory 600 and stores the identification of the accessory 600 in memory. Alternatively, the electronic control unit 202 may automatically detect an RFID tag associated with the accessory 600 attached to the person lifting device, such as when the accessory detector 276 is an RFID tag reader and the identifying indicia is an RFID tag.

The electronic control unit 202 then automatically compares the identification of the accessory 600 with an array of one or more compatible accessories associated with the identification of the sling bar 136 and stored in the memory. For example, the array of one or more compatible accessories associated with the identification of the sling bar may include a look-up table of the identification of accessories indexed according to the identification of the sling bars with which they are compatible. Compatibility may be based on, for example, the maximum weight ratings of the individual components, the number of connection points, the size of the components, and the like. For example, an accessory with a weight rating of 200 kg may be deemed compatible with a sling bar with a weight rating of 200 kg and, as such, the identification of the accessory would appear in the look up table associated with the sling bar. However, an accessory with a weight rating of 200 kg is not compatible with a sling bar with a weight rating of 100 kg and, as such the identification of the accessory would not appear in the look up table associated with the sling bar. If the identification of the accessory is not in the array of compatible accessories, then the electronic control unit 202 provides a warning signal, such as with the display 270, visual indicator 272, and/or audible indicator 274. For example, in one embodiment, the electronic control unit 202 may illuminate the visual indicator 272 as red to indicate that the sling bar 136 and accessory 600 are not compatible with one another. In some embodiments, the electronic control unit 202 may lock-out the actuation controls of the person lifting device when the identification of the accessory is not in the array of compatible accessories to prevent the person lifting device from being used until the controls are unlocked or an appropriate override code is entered. In another embodiment, if the identification of the accessory is in the array of compatible accessories, then the electronic control unit 202 provides a signal, such as with the display 270, visual indicator 272, and/or audible indicator 274. For example, in one embodiment, the electronic control unit 202 may illuminate the visual indicator 272 as green to indicate that the sling bar 136 and accessory 600 are compatible with one another.

In some embodiments, the method of operating the person lifting device may additionally include the optional preliminary step of determining if all the accessory couplings of the sling bar are connected to lifting hooks 139A, 139B of the sling bar 136. For example, the electronic control unit 202 may automatically determine a number of accessory couplings associated with the identification of the accessory 600. The number of accessory couplings associated with the identification of the accessory 600 may be, for example, stored in a memory of the electronic control unit 202 in a look-up table indexed according to the identification of the accessory 600. In the embodiment of the accessory 600 depicted in FIG. 7, the number of accessory couplings is four, for example. The electronic control unit 202 then automatically determines how many accessory couplings are attached to the sling bar 136 using the plurality of coupling detectors 260A, 260B. For example, the electronic control unit 202 may detect the presence of one or more accessory couplings attached to the lifting hooks 139A, 139B of the sling bar 136 using the unique identifier associated with the identifying indicia attached to each of the accessory couplings. That is, when the identifying indicia are RFID tags and the coupling detectors 260A, 260B are RFID tag readers, the electronic control unit may detect the unique identity associated with each accessory coupling with the RFID tag readers and, base on these unique identities, determine the number of accessory couplings attached to the lifting hooks 139A, 139B of the sling bar 136. Thereafter, the electronic control unit 202 automatically compares the number of accessory couplings associated with the identification of the accessory and the number of attached accessory couplings. When the number of accessory couplings associated with the identification of the accessory and the number of attached accessory couplings are not equal, then the electronic control unit 202 provides a warning signal, such as with the display 270, visual indicator 272, and/or audible indicator 274. For example, in one embodiment, the electronic control unit 202 may illuminate the visual indicator 272 as red to indicate that the number of accessory couplings associated with the identification of the accessory 600 and the number of attached accessory couplings are not equal. In some embodiments, the electronic control unit 202 may lock-out the actuation controls of the person lifting device when the number of accessory couplings associated with the identification of the accessory and the number of attached accessory couplings are not equal to prevent the person lifting device from being used until the controls are unlocked or an appropriate override code is entered. In another embodiment, if the number of accessory couplings associated with the identification of the accessory and the number of attached accessory couplings are equal, then the electronic control unit 202 provides a signal, such as with the display 270, visual indicator 272, and/or audible indicator 274. For example, in one embodiment, the electronic control unit 202 may illuminate the visual indicator 272 as green (or maintain the illumination as green) to indicate that the number of accessory couplings associated with the identification of the accessory and the number of attached accessory couplings are equal.

In embodiments described herein, regardless of whether the preliminary steps are performed, the electronic control unit 202 determines if each of the accessory couplings of the accessory 600 are attached to the appropriate lifting hook 139A or 139B of the sling bar 136 using the coupling detectors 260A, 260B and the unique identifier associated with each of the accessory couplings. For example, in one embodiment, the coupling detectors 260A, 260B are associated with a specific lifting hook 139A, 139B on the sling bar 136 in the memory of the electronic control unit while the accessory couplings 620A, 620B, 622A, 622B of the accessory 600 have unique identifiers encoded on their respective identifying indicia which, in some embodiments, may also include the model and/or serial number of the accessory. This allows the electronic control unit 202 to utilize the coupling detectors 260A, 260B to determine which accessory couplings 620A, 620B, 622A, 622B are attached to which lifting hooks 139A, 139B with the coupling detectors 260A, 260B and, based on the identification of the accessory 600, determine if these connections are correct.

Referring to FIGS. 5-7 by way of example, in some embodiments, the electronic control unit 202 detects an identification of an accessory coupling attached to the lifting hook 139A of sling bar 136. The identification of the accessory coupling is communicated to the electronic control unit 202 by the coupling detector 260A as an electronic signal encoded with the identification of the accessory coupling. For example, accessory 600 may be attached to sling bar 136 such that accessory coupling 622B is attached to lifting hook 139A. The coupling detector 260A, which is related to the lifting hook 139A in the memory of the electronic control unit 202, detects an identification of the accessory coupling 622B by interrogating the unique identifying indicia attached to the accessory coupling 622B and sends an electronic signal indicative of this identifying indicia to the electronic control unit 202, thereby providing the electronic control unit 202 with the identification of the accessory coupling 622B attached to the lifting hook 139A.

In embodiments where the electronic control unit 202 has detected an identification of the sling bar 136 and the accessory 600, the electronic control unit automatically compares the identification of the accessory coupling with an array of one or more compatible accessory couplings associated with the specific lifting hook 139A of the sling bar 136. The array of one or more compatible accessory couplings associated with the lifting hook 139A of the sling bar 136 may be, for example, stored in the memory of the electronic control unit 202 and linked to the identification of the sling bar 136. When the identification of the accessory coupling is not in the array of compatible accessory couplings, then the electronic control unit 202 provides a warning signal, such as with the display 270, visual indicator 272, and/or audible indicator 274. For example, in one embodiment, the electronic control unit 202 may illuminate the visual indicator 272 as red to indicate that the identification of the accessory coupling is not in the array of compatible accessory couplings. In some embodiments, the electronic control unit 202 may lock-out the actuation controls of the person lifting device when the identification of the accessory coupling is not in the array of compatible accessory couplings to prevent the person lifting device from being used until the controls are unlocked or an appropriate override code is entered. In another embodiment, if the identification of the accessory coupling is in the array of compatible accessory couplings, then the electronic control unit 202 provides a signal, such as with the display 270, visual indicator 272, and/or audible indicator 274. For example, in one embodiment, the electronic control unit 202 may illuminate the visual indicator 272 as green (or maintain the illumination as green) to indicate that the identification of the accessory coupling is in the array of compatible accessory couplings. This process is then repeated for each accessory coupling attached to the lifting hooks 139A, 139B of the sling bar 136.

In embodiments where the identifying indicia attached to the accessory coupling 622B includes both the unique identification of the accessory coupling 622B and the model number and/or serial number of the accessory 600, the electronic control unit 202 automatically compares the identification of the accessory coupling with an array of one or more compatible accessory couplings indexed according to the lifting hook 139A and the identification of different sling bars compatible with the accessory 600. The array of one or more compatible accessory couplings associated with the lifting hook 139A of the sling bar 136 may be, for example, stored in the memory of the electronic control unit 202. For example, the accessory 600 may be compatible for use with different sling bars having different numbers and/or configurations of lifting hooks. Each of the lifting hooks of the different sling bars may be associated in the array with a specific coupling detector of the person lifting apparatus. Similarly, each of the lifting hooks of the different sling bars may be associated in the array with a specific accessory coupling of a compatible accessory such as a sling. Based on these associations, the electronic control unit 202 is able to determine if the accessory coupling is properly connected to the lifting hook through a comparison of the identification of the accessory coupling with the array of one or more compatible accessory couplings associated with the lifting hook. When the identification of the accessory coupling is not in the array of compatible accessory couplings, then the electronic control unit 202 provides a warning signal, such as with the display 270, visual indicator 272, and/or audible indicator 274. For example, in one embodiment, the electronic control unit 202 may illuminate the visual indicator 272 as red to indicate that the identification of the accessory coupling is not in the array of compatible accessory couplings. In some embodiments, the electronic control unit 202 may lock-out the actuation controls of the person lifting device when the identification of the accessory coupling is not in the array of compatible accessory couplings to prevent the person lifting device from being used until the controls are unlocked or an appropriate override code is entered. In another embodiment, if the identification of the accessory coupling is in the array of compatible accessory couplings, then the electronic control unit 202 provides a signal, such as with the display 270, visual indicator 272, and/or audible indicator 274. For example, in one embodiment, the electronic control unit 202 may illuminate the visual indicator 272 as green (or maintain the illumination as green) to indicate that the identification of the accessory coupling is in the array of compatible accessory couplings. This process is then repeated for each accessory coupling attached to the lifting hooks 139A, 139B of the sling bar 136.

In embodiments where the identifying indicia attached to the accessory coupling of the accessory 600 includes both the unique identification of the accessory coupling and the model number and/or serial number of the accessory 600, the electronic control unit 202 may also verify that each of the accessory couplings 620A, 620B, 622A, 622B are attached to a lifting hook. Specifically, the memory of the electronic control unit 202 may include characteristics of accessories, such as the number of accessory couplings and the like, indexed according to the model and/or serial number of the accessory 600. The electronic control unit may compare this information with the unique identifications of the accessory couplings 620A, 620B, 622A, 622B as detected by the coupling detectors to determine if one or more of the accessory couplings is not attached to a lifting hook of the sling bar. When it is determined that one or more of the accessory couplings is not attached to a lifting hook of the sling bar, then the electronic control unit 202 provides a warning signal, such as with the display 270, visual indicator 272, and/or audible indicator 274. For example, in one embodiment, the electronic control unit 202 may illuminate the visual indicator 272 as red to indicate that one or more of the accessory couplings is not attached to a lifting hook of the sling bar. In some embodiments, the electronic control unit 202 may lock-out the actuation controls of the person lifting device when one or more of the accessory couplings is not attached to a lifting hook of the sling bar to prevent the person lifting device from being used until the controls are unlocked or an appropriate override code is entered. In another embodiment, if all the accessory couplings are attached to a lifting hook of the sling bar, then the electronic control unit 202 provides a signal, such as with the display 270, visual indicator 272, and/or audible indicator 274. For example, in one embodiment, the electronic control unit 202 may illuminate the visual indicator 272 as green (or maintain the illumination as green) to indicate that all the accessory couplings are attached to a lifting hook of the sling bar.

Still referring to FIGS. 5-7, in another embodiment, the electronic control unit 202 detects an identification of the accessory couplings attached to the lifting hooks 139A, 139B of sling bar 136. The identification of each accessory coupling is communicated to the electronic control unit 202 by the coupling detectors 260A, 260B as an electronic signal encoded with the identification of the accessory coupling, as described above. The identification of each accessory coupling may include, for example, a type of the accessory coupling. In embodiments, the type of the accessory coupling may include, for example, a general attachment location (left or right, front or back, etc.) of the sling bar 136 the accessory coupling should be attached to. Alternatively, the type of the accessory coupling may be stored in a memory of the electronic control unit and indexed according to the identification of the accessory coupling. Regardless of the embodiment, it should be understood that the electronic control unit 202 is able to discern the type of the accessory coupling based on the identification of the accessory coupling. Thereafter, the electronic control unit 202 determines if different types of accessory couplings are attached to respective lifting hooks 139A, 139B of the sling bar 136 and provides a warning signal, such as with the display 270, visual indicator 272, and/or audible indicator 274, when accessory couplings of different types are attached to the same lifting hook.

For example, accessory coupling 620A may be a "right-type", accessory coupling 622A may be a "right-type", accessory coupling 620B may be a "left-type", and accessory coupling 620A may be a "left-type". If the accessory couplings attached to, for example, lifting hook 139A include a "right-type" and a "left-type" accessory coupling, such as when accessory coupling 620A and accessory coupling 620B are both attached to lifting hook 139A, then the electronic control unit 202 provides a warning signal with the display 270, visual indicator 272, and/or audible indicator 274 indicating that the accessory 600 is improperly attached to the sling bar 136.

In one embodiment, the electronic control unit 202 may illuminate the visual indicator 272 as red to indicate that the accessory 600 is improperly attached to the sling bar 136. In some embodiments, the electronic control unit 202 may lock-out the actuation controls of the person lifting device when accessory couplings of different types are attached to the same lifting hook to prevent the person lifting device from being used until the controls are unlocked or an appropriate override code is entered. In another embodiment, if accessory couplings of the same type are attached to the same lifting hook, then the electronic control unit 202 provides a signal, such as with the display 270, visual indicator 272, and/or audible indicator 274. For example, in one embodiment, the electronic control unit 202 may illuminate the visual indicator 272 as green (or maintain the illumination as green) to indicate that accessory couplings of the same type are attached to the same lifting hook. This process is then repeated for each of the lifting hooks 139A, 139B of the sling bar 136.

In addition to determining if the same "type" of accessory couplings are attached to one lifting hook of the sling bar 136, the electronic control unit 202 may also determine if the same number of accessory couplings are attached to corresponding lifting hooks 139A, 139B on opposite ends of the sling bar 136. For example, the electronic control unit 202 may determine how many accessory couplings are attached to each of the lifting hooks 139A, 139B based on the identifications of the accessory couplings transmitted by each of the coupling detectors 260A, 260B associated with the lifting hooks 139A, 139B. The electronic control unit 202 may then compare the number of accessory couplings attached to the first lifting hook 139A with the number of accessory couplings attached to the second lifting hook 139B. When the electronic control unit determines that the number of accessory couplings attached to the first lifting hook 139A is different than the number of accessory couplings attached to the second lifting hook 139B, the electronic control unit 202 provides a warning, such as with the display 270, visual indicator 272, and/or audible indicator 274. For example, in one embodiment, the electronic control unit 202 may illuminate the visual indicator 272 as red to indicate that the number of accessory couplings attached to the first lifting hook 139A is different than the number of accessory couplings attached to the second lifting hook 139B. In some embodiments, the electronic control unit 202 may lock-out the actuation controls of the person lifting device when the number of accessory couplings attached to the first lifting hook 139A is different than the number of accessory couplings attached to the second lifting hook 139B to prevent the person lifting device from being used until the controls are unlocked or an appropriate override code is entered. In another embodiment, if the number of accessory couplings attached to the first lifting hook 139A is the same as the number of accessory couplings attached to the second lifting hook 139B, then the electronic control unit 202 provides a signal, such as with the display 270, visual indicator 272, and/or audible indicator 274. For example, in one embodiment, the electronic control unit 202 may illuminate the visual indicator 272 as green (or maintain the illumination as green) to indicate that the number of accessory couplings attached to the first lifting hook 139A is the same as the number of accessory couplings attached to the second lifting hook 139B.

Referring now to FIGS. 5-9, in another embodiment, coupling detectors 260A, 260B may be used to determine if an accessory coupling 620A, 620B, 622A, 622B of an accessory 600 (e.g., a sling loop of a sling) is properly attached to a lifting hook 139A, 139B of a sling bar 136. In this embodiment, the coupling detector 260A, 260B may be, for example, machine vision systems or cameras.

Figure 8:
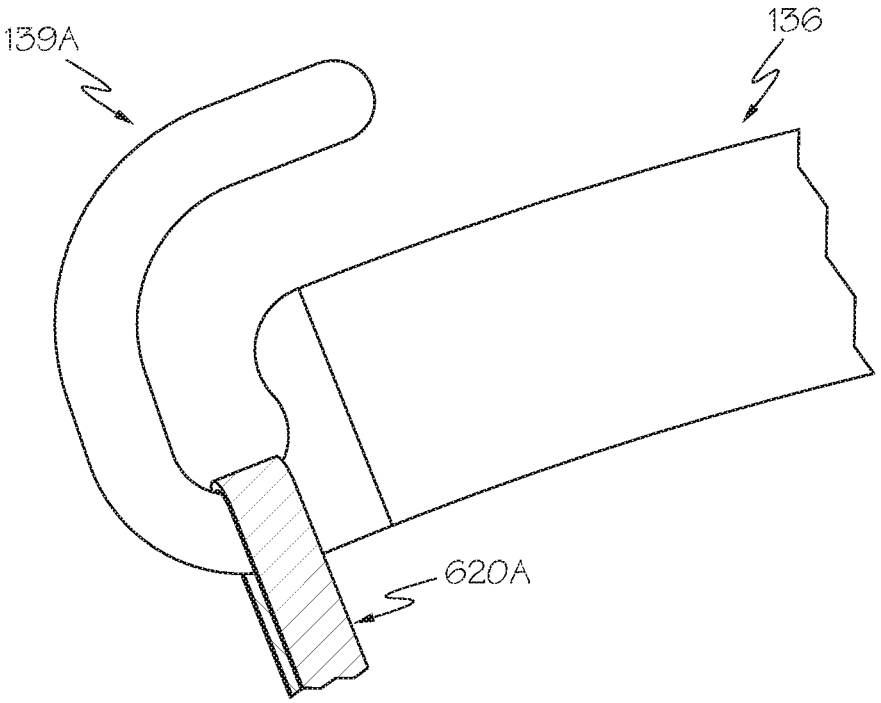
FIG. 8 schematically depicts an accessory coupling (i.e., a sling loop) of an accessory (i.e., a sling) properly coupled to a lifting hook of a sling bar.
Figure 9:
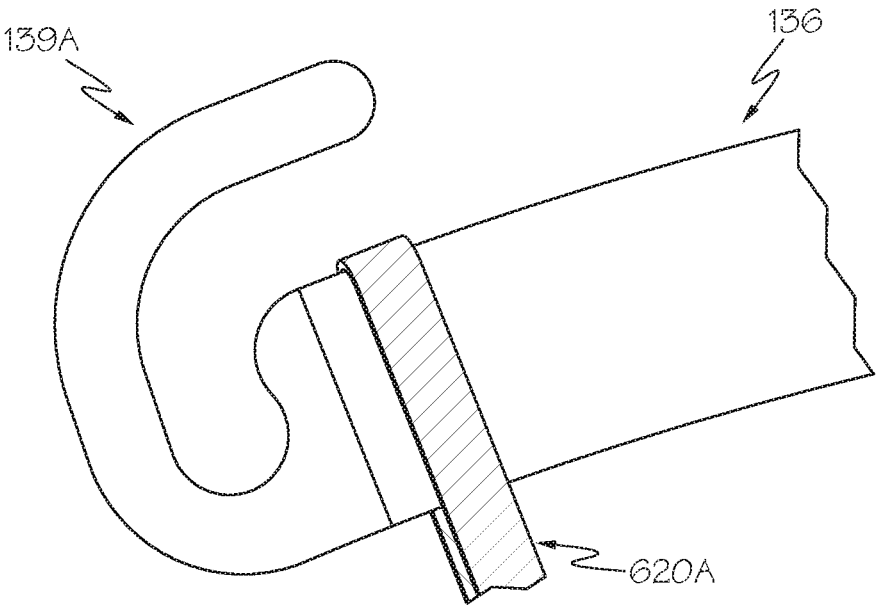
FIG. 9 schematically depicts an accessory coupling (i.e., a sling loop) of an accessory (i.e., a sling) improperly coupled to a lifting hook of a sling bar.

Specifically, the coupling detector 260A, 260B captures an image of the accessory coupling (for example, accessory coupling 620A) coupled to a lifting hook (for example lifting hook 139A) of the sling bar 136 and communicates this image to the electronic control unit 202. The electronic control unit 202 then compares this image to an image of an accessory coupling properly seated in a lifting hook stored in a memory of the electronic control unit 202 using image analysis techniques and, based on the comparison, determines if the accessory coupling is properly or improperly seated in the lifting hook 139A. For example, an accessory coupling 620A properly seated in a lifting hook 139A of a sling bar 136 is depicted in FIG. 8. And, for purposes of comparison, an accessory coupling 620A improperly seated in a lifting hook 139A is depicted in FIG. 9. Comparing FIG. 8 to FIG. 9, it is noted that the accessory coupling 620A in FIG. 9 is not secured in the lifting hook 139A and, as such, the accessory coupling is not be properly coupled to the lifting hook 139A. Assuming FIG. 9 is the image captured by one of the coupling detectors 260A and FIG. 8 is the image of a properly seated accessory coupling stored in a memory of the electronic control unit 202, the electronic control unit would, for example, compare the image of FIG. 9 to the image of FIG. 8 to determine if the accessory coupling is properly or improperly coupled to the lifting hook 139A.

If the electronic control unit 202 determines that the image captured by the coupling detector 260A is different than the image of the properly seated accessory coupling 620A stored in memory, the electronic control unit 202 provides a warning, such as with the display 270, visual indicator 272, and/or audible indicator 274. For example, in one embodiment, the electronic control unit 202 may illuminate the visual indicator 272 as red to indicate that the accessory coupling 620A is improperly seated in the lifting hook 139A. In some embodiments, the electronic control unit 202 may lock-out the actuation controls of the person lifting device when the accessory coupling 620A is improperly seated in the lifting hook 139A to prevent the person lifting device from being used until the controls are unlocked or an appropriate override code is entered. In another embodiment, if the accessory coupling 620A is properly seated in the lifting hook 139A, then the electronic control unit 202 provides a signal, such as with the display 270, visual indicator 272, and/or audible indicator 274. For example, in one embodiment, the electronic control unit 202 may illuminate the visual indicator 272 as green (or maintain the illumination as green) to indicate that the accessory coupling 620A is properly seated in the lifting hook 139A.

In this embodiment, the electronic control unit may perform a preliminary step of determining if the sling bar 136 and the accessory 600 attached to the sling bar 136 are compatible. In some embodiments, this may be done utilizing the accessory detector of person lifting device, as described herein. However, in alternative embodiments, this may be done by capturing images of the sling bar 136 and accessory 600 with, for example, the coupling detectors 260A, 260B and comparing the captured images with images stored in a memory of the electronic control unit 200 to determine an identity of the sling bar 136 and accessory 600. Once the identities of the sling bar 136 and accessory 600 are determined, the electronic control unit 200 may determine if the sling bar 136 and accessory 600 are compatible by searching a look up table of compatible accessories associated with the sling bar 136 to determine if the identity of the accessory is within the look up table of compatible accessories. This method of optical recognition of accessory/sling bar identity to determine accessory compatibility may be used in conjunction with any of the methods described herein.

If the electronic control unit 202 determines that the accessories are not compatible, the electronic control unit 202 provides a warning, such as with the display 270, visual indicator 272, and/or audible indicator 274. For example, in one embodiment, the electronic control unit 202 may illuminate the visual indicator 272 as red to indicate that the accessory 600 and the sling bar 136 are not compatible. In some embodiments, the electronic control unit 202 may lock-out the actuation controls of the person lifting device when the accessory 600 and the sling bar 136 are not compatible. In another embodiment, if the accessory 600 and the sling bar 136 are compatible, then the electronic control unit 202 provides a signal, such as with the display 270, visual indicator 272, and/or audible indicator 274. For example, in one embodiment, the electronic control unit 202 may illuminate the visual indicator 272 as green (or maintain the illumination as green) to indicate that the the accessory 600 and the sling bar 136 are compatible.

Based on the foregoing, it should be understood that the electronic control unit 202 may be programmed to provide a warning signal with the display 270, visual indicator 272 and/or the audible indicator 274 to a caregiver operating the person lifting device when non-compatible components (such as sling bars and accessories) are attached to the person lifting device and/or when an accessory is improperly attached to a sling bar. In embodiments, the electronic control unit 202 may also be programmed to provide a warning signal with the display 270, visual indicator 272, and/or the audible indicator 274 to a caregiver operating the person lifting device based on the status of the battery 146 that power the person lifting device. For example, the electronic control unit 202 may illuminate the visual indicator 272 as green (or maintain the illumination as green) to indicate that the battery 146 is fully charged or, alternatively may illuminate the visual indicator as green and flash the visual indicator 272 to indicate that the battery 146 is charging. Alternatively, the electronic control unit 202 may illuminate the visual indicator 272 as red to indicate that the battery 146 needs to be charged. In this embodiment, the electronic control unit 202 may also lock-out the actuation controls of the person lifting device when the battery 146 needs to be charged to prevent the person lifting device from being used until the controls are unlocked or an appropriate override code is entered.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A method for operating a person lifting device, the method comprising:

detecting, with a first coupling detector, an identification of a first accessory coupling attached to a first lifting hook of a sling bar of the person lifting device;

determining, automatically with an electronic control unit communicatively coupled to the first coupling detector, a type of the first accessory coupling based on the identification of the first accessory coupling, wherein the type of the first accessory coupling is based on a predetermined attachment configuration for attaching the first accessory coupling to the sling bar;

detecting, with the first coupling detector, an identification of a second accessory coupling attached to the first lifting hook of the sling bar of the person lifting device;

determining, automatically with the electronic control unit communicatively coupled to the first coupling detector, a type of the second accessory coupling based on the identification of the second accessory coupling, wherein the type of the second accessory coupling is based on a predetermined attachment configuration for attaching the second accessory coupling to the sling bar;

comparing, with the electronic control unit communicatively coupled to the first coupling detector, the type of the first accessory coupling and the type of the second accessory coupling; and communicating, automatically with the electronic control unit, a warning signal indicating that an accessory is improperly attached to the sling bar when the type of the first accessory coupling and the type of the second accessory coupling are different.

2. The method of claim 1, further comprising locking-out an actuation control of the person lifting device when the type of the first accessory coupling and the type of the second accessory coupling are different.

3. The method of claim 1, further comprising:

determining, automatically with the first coupling detector and the electronic control unit, a number of accessory couplings attached to the first lifting hook of the sling bar of the person lifting device;

determining, with a second coupling detector and the electronic control unit, a number of accessory couplings attached to a second lifting hook of the sling bar of the person lifting device; and communicating, automatically with the electronic control unit, a warning signal when the number of accessory couplings attached to the first lifting hook of the sling bar of the person lifting device is different than the number of accessory couplings attached to the second lifting hook of the sling bar of the person lifting device.

4. The method of claim 3, further comprising:

locking-out an actuation control of the person lifting device when the number of accessory couplings attached to the first lifting hook of the sling bar of the person lifting device is different than the number of accessory couplings attached to the second lifting hook of the sling bar of the person lifting device.

5. The method of claim 1, wherein:

the first accessory coupling and the second accessory coupling comprise RFID tags encoded with the identification; and the first coupling detector comprises an RFID reader.

6. The method of claim 1, wherein the warning signal is communicated by illuminating a visual indicator.

7. A method for operating a person lifting device, the method comprising:

detecting, with at least one coupling detector, an identification of an accessory coupling of an accessory attached to a lifting hook of a sling bar of the person lifting device;

comparing, automatically with an electronic control unit communicatively coupled to the at least one coupling detector, the identification of the accessory coupling with an array of one or more compatible accessory couplings associated with the lifting hook of the sling bar; and communicating, automatically with the electronic control unit, a warning signal indicative of the accessory coupling being improperly attached to the sling bar when the identification of the accessory coupling is not in the array of one or more compatible accessory couplings.

8. The method of claim 7, further comprising:

locking-out an actuation control of the person lifting device when the identification of the accessory coupling is not in the array of one or more compatible accessory couplings.

9. The method of claim 7 further comprising the preliminary steps of:

detecting, with an accessory detector communicatively coupled to the electronic control unit, an identification of the sling bar;

detecting, with the accessory detector, an identification of the accessory;

comparing, automatically with the electronic control unit, the identification of the accessory with an array of one or more compatible accessories associated with the identification of the sling bar; and communicating, automatically with the electronic control unit, a warning signal when the identification of the accessory is not in the array of one or more compatible accessories.

10. The method of claim 9 further comprising:

locking-out an actuation control of the person lifting device when the identification of the accessory coupling is not in the array of one or more compatible accessories.

11. The method of claim 9 further comprising:

determining, automatically with the electronic control unit, a number of accessory couplings associated with the identification of the accessory;

determining, automatically with the at least one coupling detector and the electronic control unit, a number of attached accessory couplings attached to lifting hooks of the sling bar;

comparing, automatically with the electronic control unit, the number of accessory couplings associated with the identification of the accessory and the number of attached accessory couplings; and communicating, automatically with the electronic control unit, a warning signal when the number of accessory couplings associated with the identification of the accessory and the number of attached accessory couplings are not equal.

12. The method of claim 11 further comprising:

locking-out an actuation control of the person lifting device when the number of accessory couplings associated with the identification of the accessory and the number of attached accessory couplings are not equal.

13. The method of claim 7, wherein the warning signal is communicated by illuminating a visual indicator.

14. A person lifting device comprising:

a lift actuator operatively connected to a sling bar, whereby the lift actuator raises and lowers the sling bar;

at least one coupling detector; and an electronic control unit communicatively coupled to the lift actuator and the at least one coupling detector, the electronic control unit comprising a processor and a computer readable and executable instruction set which, when executed by the processor:

detects, automatically with the at least one coupling detector, an identification of an accessory coupling of an accessory attached to a lifting hook of the sling bar of the person lifting device;

compares, automatically with the electronic control unit communicatively coupled to the at least one coupling detector, the identification of the accessory coupling with an array of one or more compatible accessory couplings associated with the lifting hook of the sling bar; and communicates, automatically with the electronic control unit, a warning signal indicative of the accessory coupling being improperly attached to the sling bar when the identification of the accessory coupling is not in the array of one or more compatible accessory couplings.

15. The person lifting device of claim 14 further comprising:

a lift mast mechanically coupled to a base at a first end of the lift mast;

a lift arm pivotally coupled to the lift mast at a second end of the lift mast, wherein a sling bar is operatively connected to the lift arm, the lift actuator is mechanically coupled to the lift mast and the lift arm, and actuation of the lift actuator raises or lowers the lift arm relative to the base; and the at least one coupling detector operatively connected to at least one of the lift arm and the sling bar.

16. The person lifting device of claim 15, wherein the at least one coupling detector is connected to the lift arm and has an active area that extends from the at least one coupling detector by a distance sufficient to envelope an end portion of the sling bar.

17. The person lifting device of claim 14, further comprising:

a carriage slidably disposed in a rail for relative movement to the rail;

a lift unit coupled to the carriage, the lift unit comprising the lift actuator paying out and taking up a lifting strap, wherein a sling bar is attached to an end of the lifting strap; and the at least one coupling detector is operatively connected to the lift unit.

18. The person lifting device of claim 17, wherein the at least one coupling detector has an active area that extends from the at least one coupling detector by a distance sufficient to envelope an end portion of the sling bar.

19. The person lifting device of claim 14, wherein the accessory is at least one of a lifting sling, a lifting vest, lifting sheet, and a repositioning sheet.

20. The person lifting device of claim 14, wherein the computer readable and executable instruction set, when executed by the processor, also preliminarily:

detects, with an accessory detector communicatively coupled to the electronic control unit, an identification of the sling bar;

detects, with the accessory detector, an identification of the accessory;

compares, automatically with the electronic control unit, the identification of the accessory with an array of one or more compatible accessories associated with the identification of the sling bar; and communicates, automatically with the electronic control unit, a warning signal when the identification of the accessory is not in the array of one or more compatible accessories.

21. The person lifting device of claim 20, wherein the computer readable and executable instruction set, when executed by the processor, also:

locks-out an actuation control of the person lifting device when the identification of the accessory is not in the array of one or more compatible accessories.

22. The person lifting device of claim 20, wherein the computer readable and executable instruction set, when executed by the processor, also:

determines, automatically with the electronic control unit, a number of accessory couplings associated with the identification of the accessory;

determines, automatically with the at least one coupling detector and the electronic control unit, a number of attached accessory couplings attached to lifting hooks of the sling bar;

compares, automatically with the electronic control unit, the number of accessory couplings associated with the identification of the accessory and the number of attached accessory couplings; and communicates, automatically with the electronic control unit, a warning signal when the number of accessory couplings associated with the identification of the accessory and the number of attached accessory couplings are not equal.

23. The person lifting device of claim 22, wherein the computer readable and executable instruction set, when executed by the processor, also:

locks-out an actuation control of the person lifting device when the number of accessory couplings associated with the identification of the accessory and the number of attached accessory couplings are not equal.

24. A person lifting device comprising:

a lift actuator operatively connected to a sling bar, whereby the lift actuator raises and lowers the sling bar;

at least one coupling detector; and an electronic control unit communicatively coupled to the lift actuator and the at least one coupling detector, the electronic control unit comprising a processor and a computer readable and executable instruction set which, when executed by the processor:

detects, with a first coupling detector, an identification of a first accessory coupling of an accessory attached to a first lifting hook of the sling bar of the person lifting device;

determines, automatically with the electronic control unit communicatively coupled to the first coupling detector, a type of the first accessory coupling based on the identification of the first accessory coupling, wherein the type of the first accessory coupling is based on a predetermined attachment configuration for attaching the first accessory coupling to the sling bar;

detects, with the first coupling detector, an identification of a second accessory coupling of the accessory attached to the first lifting hook of the sling bar of the person lifting device;

determines, automatically with the electronic control unit communicatively coupled to the first coupling detector, a type of the second accessory coupling based on the identification of the second accessory coupling, wherein the type of the second accessory coupling is based on a predetermined attachment configuration for attaching the second accessory coupling to the sling bar;

compares, with the electronic control unit communicatively coupled to the first coupling detector, the type of the first accessory coupling and the type of the second accessory coupling; and communicates, automatically with the electronic control unit, a warning signal indicating that the accessory is improperly attached to the sling bar when the type of the first accessory coupling and the type of the second accessory coupling are different.

25. The person lifting device of claim 24 further comprising:

a lift mast mechanically coupled to a base at a first end of the lift mast;

a lift arm pivotally coupled to the lift mast at a second end of the lift mast, wherein a sling bar is operatively connected to the lift arm, the lift actuator is mechanically coupled to the lift mast and the lift arm, and actuation of the lift actuator raises or lowers the lift arm relative to the base; and the at least one coupling detector operatively connected to at least one of the lift arm and the sling bar.

26. The person lifting device of claim 25, wherein the at least one coupling detector is connected to the lift arm and has an active area that extends from the at least one coupling detector by a distance sufficient to envelope an end portion of the sling bar.

27. The person lifting device of claim 24, further comprising:

a carriage slidably disposed in a rail for relative movement to the rail;

a lift unit coupled to the carriage, the lift unit comprising the lift actuator paying out and taking up a lifting strap, wherein a sling bar is attached to an end of the lifting strap; and the at least one coupling detector is operatively connected to the lift unit.

28. The person lifting device of claim 27, wherein the at least one coupling detector has an active area that extends from the at least one coupling detector by a distance sufficient to envelope an end portion of the sling bar.

29. The person lifting device of claim 24, wherein the accessory is at least one of a lifting sling, a lifting vest, lifting sheet, and a repositioning sheet.

30. The person lifting device of claim 24, wherein the computer readable and executable instruction set, when executed by the processor, also:

locks-out an actuation control of the person lifting device when the type of the first accessory coupling and the type of the second accessory coupling are different.

31. The person lifting device of claim 24, wherein the computer readable and executable instruction set, when executed by the processor, also:

determines, automatically with the first coupling detector and the electronic control unit, a number of accessory couplings attached to the first lifting hook of the sling bar of the person lifting device;

determines, with a second coupling detector and the electronic control unit, a number of accessory couplings attached to a second lifting hook of the sling bar of the person lifting device; and communicates, automatically with the electronic control unit, a warning signal when the number of accessory couplings attached to the first lifting hook of the sling bar of the person lifting device is different than the number of accessory couplings attached to the second lifting hook of the sling bar of the person lifting device.

32. The person lifting device of claim 31, wherein the computer readable and executable instruction set, when executed by the processor, also:

locks-out an actuation control of the person lifting device when the number of accessory couplings attached to the first lifting hook of the sling bar of the person lifting device is different than the number of accessory couplings attached to the second lifting hook of the sling bar of the person lifting device.

33. A method for operating a person lifting device, the method comprising:

capturing, with at least one coupling detector, an image of an accessory coupling of an accessory attached to a sling bar of the person lifting device;

comparing, automatically with an electronic control unit communicatively coupled to the at least one coupling detector, the image of the accessory coupling with an image of a properly connected accessory coupling stored in a memory of the electronic control unit; and communicating, automatically with the electronic control unit, a warning signal when the image of the accessory coupling is different than the image of the properly connected accessory coupling.

34. The method of claim 33, further comprising:

locking-out an actuation control of the person lifting device when the image of the accessory coupling is different than the image of the properly connected accessory coupling.

35. The method of claim 33, further comprising the preliminary steps of:

detecting, with an accessory detector communicatively coupled to the electronic control unit, an identification of the sling bar;

detecting, with the accessory detector, an identification of the accessory;

comparing, automatically with the electronic control unit, the identification of the accessory with an array of one or more compatible accessories associated with the identification of the sling bar; and communicating, automatically with the electronic control unit, a warning signal when the identification of the accessory is not in the array of one or more compatible accessories.

36. The method of claim 35, further comprising:

locking-out an actuation control of the person lifting device when the identification of the accessory coupling is not in the array of one or more compatible accessories.

37. The method of claim 33, further comprising the preliminary steps of:

capturing, with at least one coupling detector, an image of an accessory coupled to the person lifting device;

capturing, with at least one coupling detector, an image of a sling bar coupled to the person lifting device;

determining an identification of the accessory based on the image of the accessory;

determining an identification of the sling bar based on the image of the sling bar;

comparing, automatically with the electronic control unit, the identification of the accessory with an array of one or more compatible accessories associated with the identification of the sling bar; and communicating, automatically with the electronic control unit, a warning signal when the identification of the accessory is not in the array of one or more compatible accessories.

38. The method of claim 37, further comprising:

locking-out an actuation control of the person lifting device when the identification of the accessory coupling is not in the array of one or more compatible accessories.

* * * * *